US011565277B2

(12) United States Patent
Lee

(10) Patent No.: US 11,565,277 B2
(45) Date of Patent: Jan. 31, 2023

(54) COMPACT HOT AIR GUN

(71) Applicant: Pro-Iroda Industries, Inc., Taichung (TW)

(72) Inventor: Yung Chieh Lee, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 178 days.

(21) Appl. No.: 17/143,393

(22) Filed: Jan. 7, 2021

(65) Prior Publication Data

US 2021/0237108 A1 Aug. 5, 2021

(30) Foreign Application Priority Data

Feb. 3, 2020 (TW) ..... 109103270

(51) Int. Cl.
*B05B 11/00* (2006.01)

(52) U.S. Cl.
CPC ..... *B05B 11/0002* (2013.01); *B05B 11/3042* (2013.01); *B05B 11/3057* (2013.01)

(58) Field of Classification Search
CPC ..... B05B 11/0002; B05B 11/3042; B05B 11/3057
USPC ..... 239/132, 133, 135, 526
See application file for complete search history.

(56) References Cited

U.S. PATENT DOCUMENTS 3,219,027 A * 11/1965 Roche ..... B05B 7/162 239/129
2016/0100456 A1 4/2016 Tsai

FOREIGN PATENT DOCUMENTS

| | | | |
|---|---|---|---|
| CA | 2488560 | A1 | 1/2006 |
| CN | 202254259 | U | 5/2012 |
| CN | 105546577 | A | 5/2016 |
| CN | 206216073 | U | 6/2017 |
| CN | 207094660 | U | 3/2018 |
| CN | 209197134 | U | 8/2019 |
| TW | M373620 | U | 2/2010 |
| TW | I659670 | B | 5/2019 |

* cited by examiner

*Primary Examiner* — Christopher S Kim
(74) *Attorney, Agent, or Firm* — Alan D. Kamrath; Karin L. Williams; Mayer & Williams PC

(57) ABSTRACT

A compact hot air gun comprising a body, an air blowing pump, an air outlet tube, and a heating coil. The air blowing pump is disposed in the body. The air outlet tube has an end connected to the air blowing pump and another end extending beyond the body. The heating coil is disposed in the another end of the air outlet tube opposite to the air blowing pump. The compact hot air gun can generate an ignition effect by using hot air through the above structure.

6 Claims, 6 Drawing Sheets

COMPACT HOT AIR GUN

BACKGROUND OF THE INVENTION

The present invention relates to a hot air gun and, more particularly, to a compact hot air gun.

Taiwan Patent No. 1659670 discloses a high-efficiency electric heating device includes a body and a heating head connected to the body. The heating head includes a heating wire and a heat accumulator. The heating wire includes a first section, a second section connected to the first section, and a third section connected to an end of the second section opposite to the first section. The first section is made of copper. The second section is made of stainless steel. The third section is made of iron-chromium wire. The heat accumulator envelops an outer periphery of the third section and is made of porcelain clay.

The most common way to light a fire is using a flame gun or the above electric heating device. However, a flame gun uses a gas as fuel, which has high demands in the environment for storage or carriage, higher risks, and limitation in orientation during use. Furthermore, the above electric heating device needs to contact with an object for ignition.

In view of the drawbacks of the above conventional structure, Applicant has designed a compact hot air gun that overcomes all drawbacks of the conventional structure.

BRIEF SUMMARY OF THE INVENTION

The primary objective of the present invention is to provide a compact hot air gun comprising a body, an air blowing pump, an air outlet tube, and a heating coil. The air blowing pump is disposed in the body. The air outlet tube has an end connected to the air blowing pump and another end extending beyond the body. The heating coil is disposed in the another end of the air outlet tube opposite to the air blowing pump. The compact hot air gun can generate an ignition effect by using hot air through the above structure.

In an example, the air outlet tube includes an insulating seat, an electrically conductive tube, an insulating tube, and a central wire. The insulating seat is disposed in the body. An end of the electrically conductive tube is connected to the insulating seat. Another end of the electrically conductive tube extends beyond the body. The insulating tube is disposed in the electrically conductive tube. The insulating tube is adjacent to the another end of the electrically conductive tube opposite to the insulating seat. The central wire is connected to the insulating seat. An end of the central wire extends through an interior of the electrically conductive tube and is adjacent to the insulating tube. The central wire is not in contact with the electrically conductive tube. An end of the heating coil has a first connecting portion. Another end of the heating coil has a second connecting portion. The first connecting portion is connected to the electrically conductive tube. The second connecting portion extends into the insulating tube and is connected to the central wire.

In an example, the heating coil includes a heating portion between the end and the another end thereof. The heating portion is coiled to form at least one circle. The heating portion is aligned with an outlet of the another end of the electrically conductive tube opposite to the insulating seat.

In an example, an electrically conductive coil is connected to and mounted around the electrically conductive tube. The electrically conductive coil coils around the electrically conductive tube at least one turn.

In an example, the air outlet tube includes a hood is disposed on the another end of the electrically conductive tube opposite to the insulating seat. An interior space of the hood intercommunicates with an interior space of the electrically conductive tube. The heating coil is disposed in the hood. An end of the hood opposite to the electrically conductive tube has an opening. The heating coil is disposed between the opening and the electrically conductive tube. The hood includes a plurality of side holes extending in radial directions of the electrically conductive tube. The plurality of side holes intercommunicates the interior space of the hood with an outside of the hood.

In an example, the air outlet tube includes an air guiding tube which is flexible. An end of the air guiding tube is disposed on an end of the insulating seat opposite to the electrically conductive tube. An interior space of the air guiding tube intercommunicates with an interior space of the insulating seat. Another end of the insulating seat opposite to the air guiding tube is received in the electrically conductive tube. The interior space of the insulating seat intercommunicates with the interior space of the electrically conductive tube.

In an example, an end of the central wire opposite to the heating coil extends between the electrically conductive tube and the air guiding tube and extends beyond the insulating seat. The body receives a power supply and a switch. The power supply is connected to the switch, the air blowing pump, the end of the central wire opposite to the heating coil, and the heating coil by wires to form an electric circuit. The switch controls running or stop of the air blowing pump and controls heating or non-heating of the heating coil.

The present invention will become clearer in light of the following detailed description of illustrative embodiments of this invention described in connection with the drawings.

DETAILED DESCRIPTION OF THE INVENTION

Figure 1:
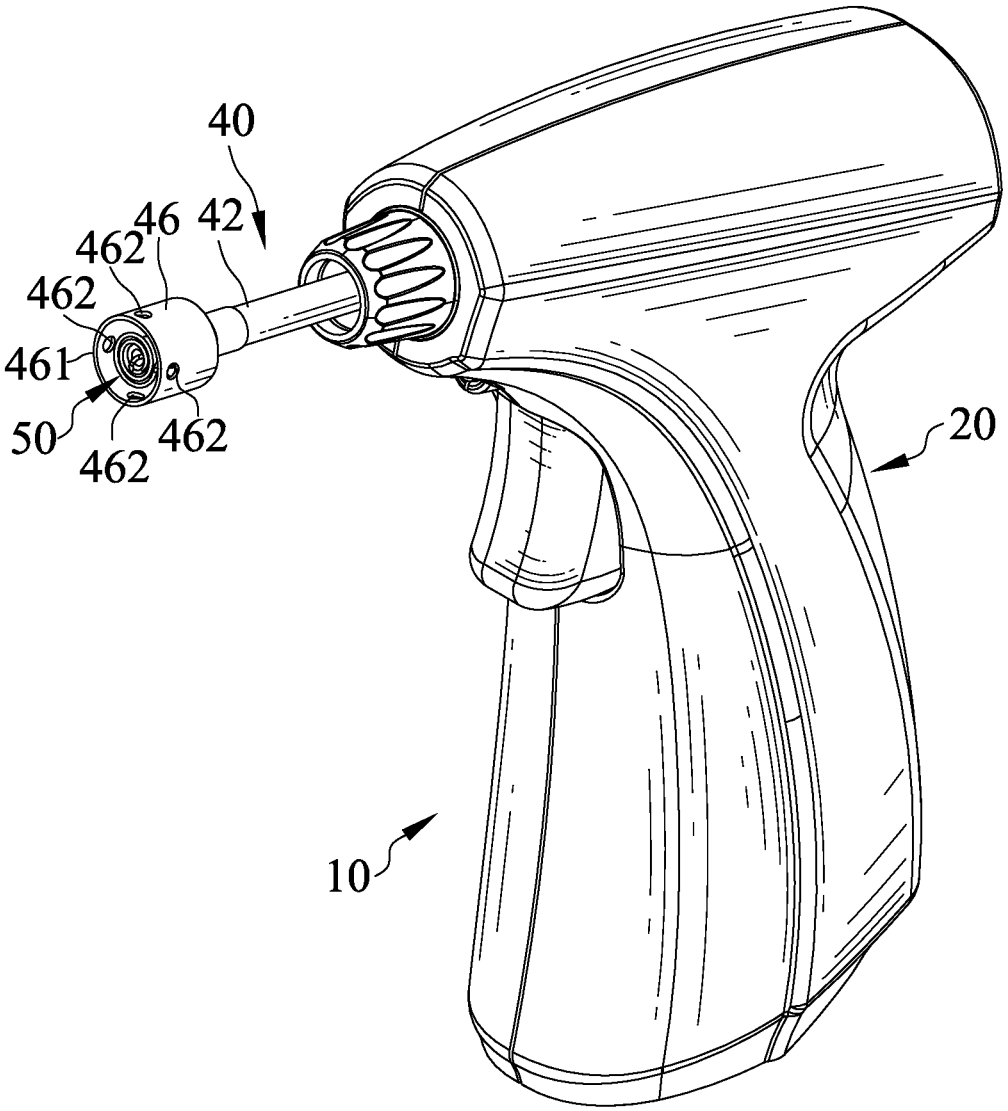
FIG. 1 is a perspective view of a compact hot air gun according to the present invention.
Figure 2:
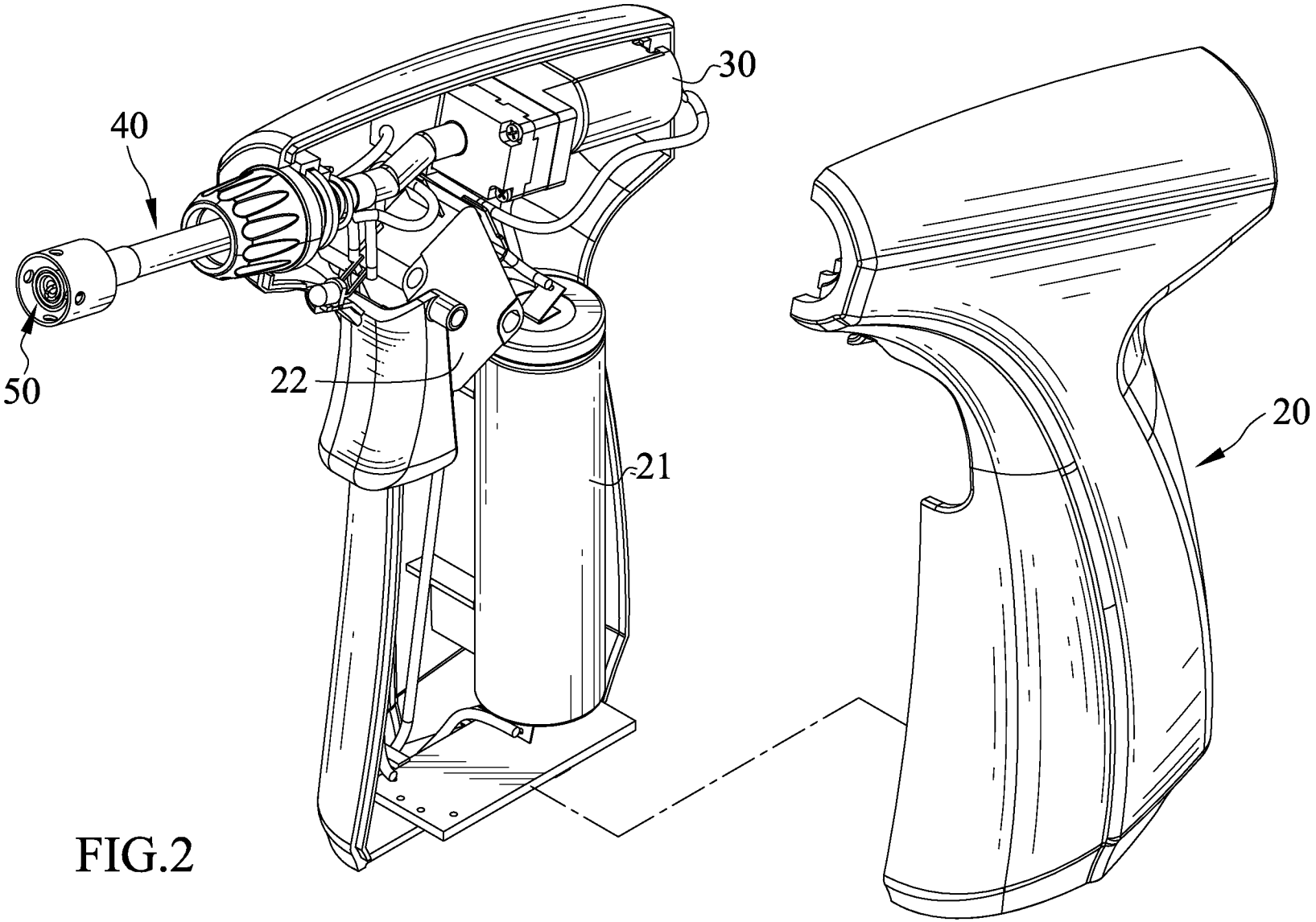
FIG. 2 is a partly-exploded perspective view of the compact hot air gun according to the present invention.
Figure 3:
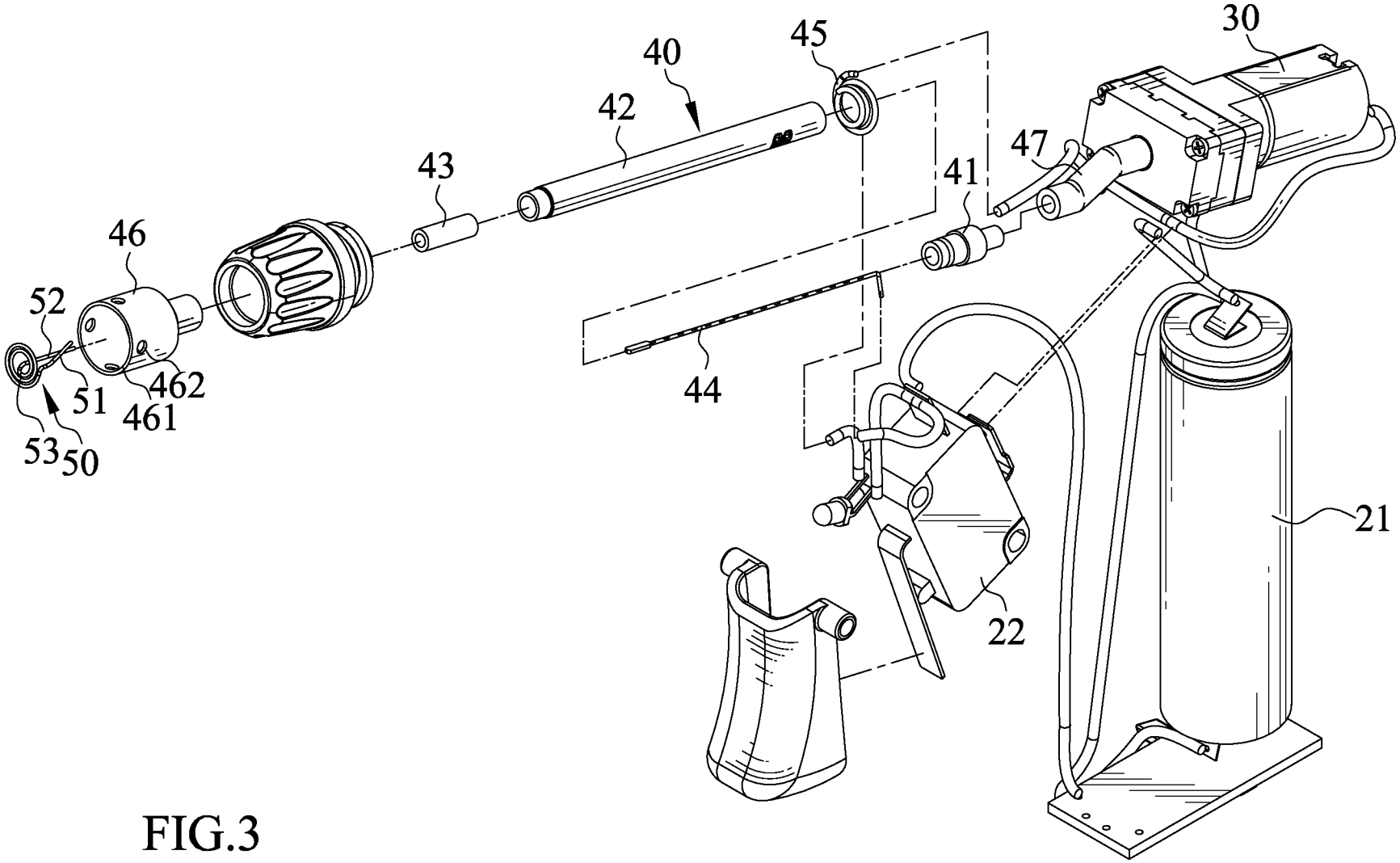
FIG. 3 is an exploded perspective view of the compact hot air gun according to the present invention.
Figure 4:
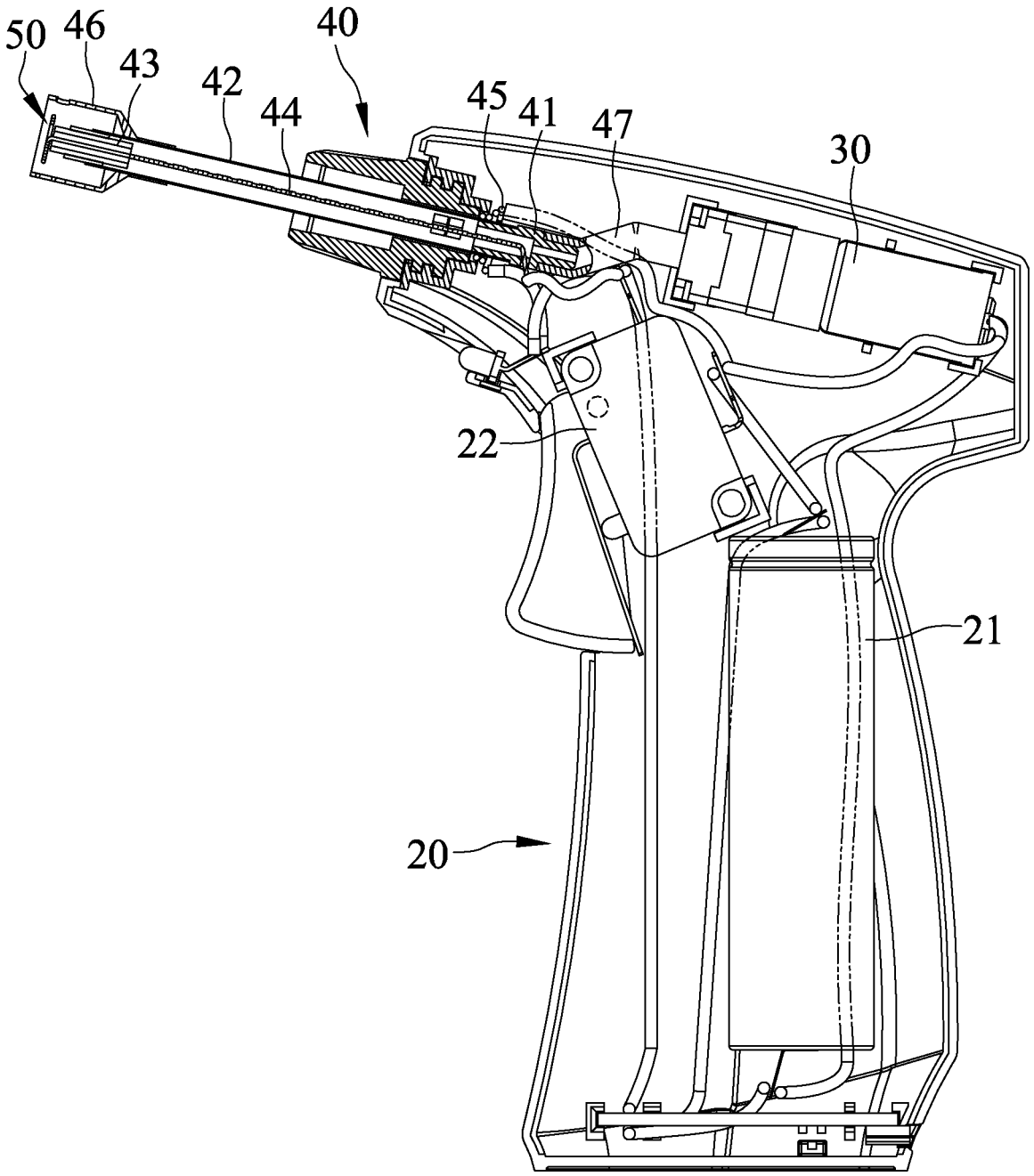
FIG. 4 is a cross sectional view of the compact hot air gun according to the present invention.
Figure 5:
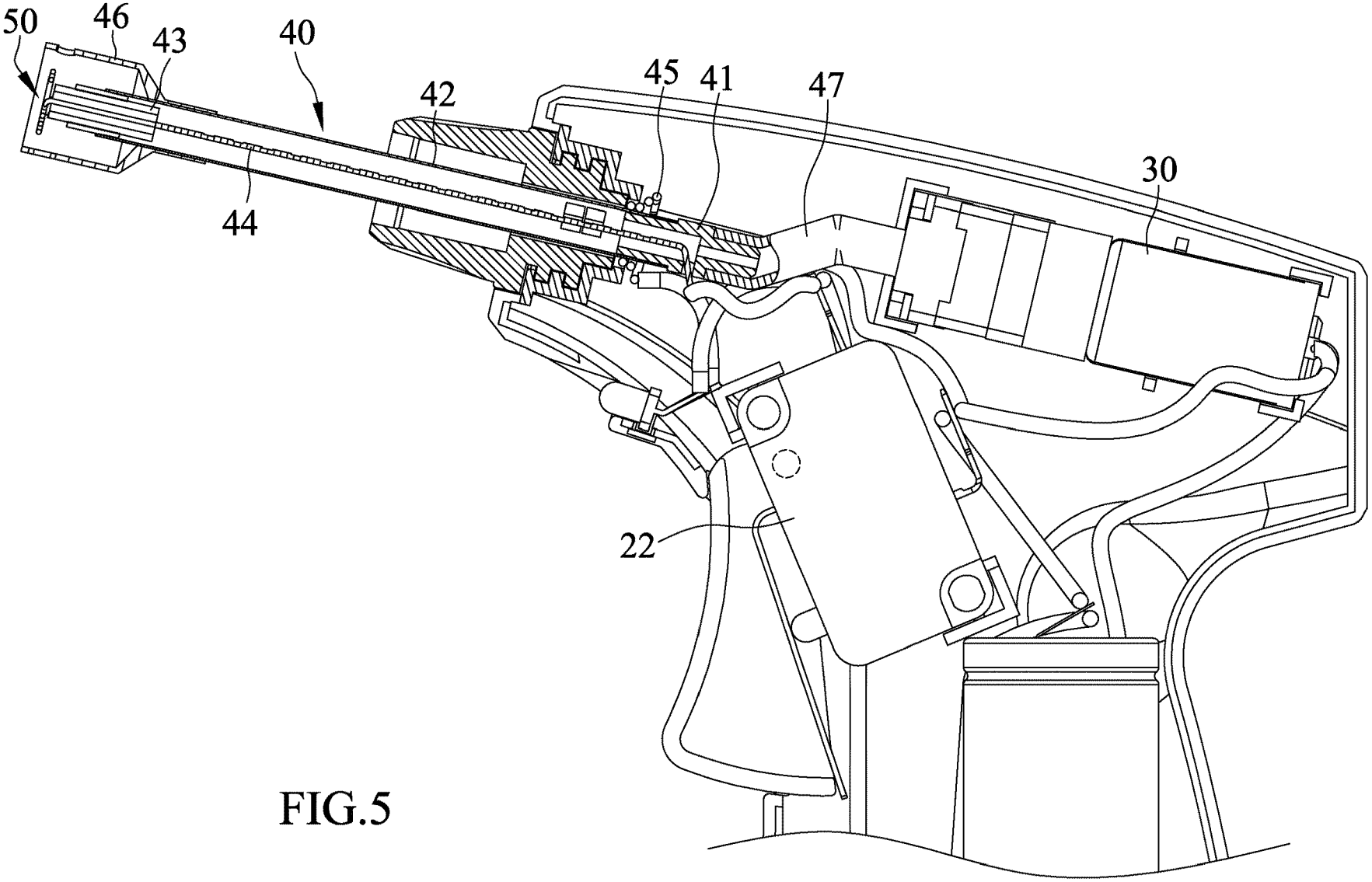
FIG. 5 is a partial, enlarged, cross sectional view of the compact hot air gun according to the present invention.

With reference to FIGS. 1-5 showing the perspective view, exploded perspective views, and cross sectional views of a compact hot air gun 10 according to the present invention, the compact hot air gun 10 comprises a body 20, an air blowing pump 30, an air outlet tube 40, and a heating coil 50. The air blowing pump 30 is disposed in the body 20. The air outlet tube 40 has an end connected to the air blowing pump 30 and another end extending beyond the body 20. The heating coil 50 is disposed in the another end of the air outlet tube 40 opposite to the air blowing pump 30.

The air outlet tube 40 includes an insulating seat 41, an electrically conductive tube 42, an insulating tube 43, and a central wire 44. The insulating seat 41 is disposed in the body 20. An end of the electrically conductive tube 42 is connected to the insulating seat 41. Another end of the electrically conductive tube 42 extends beyond the body 20. The insulating tube 43 is disposed in the electrically conductive tube 42. The insulating tube 43 is adjacent to the another end of the electrically conductive tube 42 opposite to the insulating seat 41. The central wire 44 is connected to the insulating seat 41. An end of the central wire 44 extends through an interior of the electrically conductive tube 42 and is adjacent to the insulating tube 43. The central wire 44 is not in contact with the electrically conductive tube 42. An end of the heating coil 50 has a first connecting portion 51. Another end of the heating coil 50 has a second connecting portion 52. The first connecting portion 51 is connected to the electrically conductive tube 42. The second connecting portion 52 extends into the insulating tube 43 and is connected to the central wire 44.

The heating coil 50 includes a heating portion 53 between the end and the another end thereof. The heating portion 53 is coiled to form at least one circle. The heating portion 53 is aligned with an outlet of the another end of the electrically conductive tube 42 opposite to the insulating seat 41.

An electrically conductive coil 45 is connected to and mounted around the electrically conductive tube 42. The electrically conductive coil 45 coils around the electrically conductive tube 42 at least one turn.

The air outlet tube 40 includes a hood 46 is disposed on the another end of the electrically conductive tube 42 opposite to the insulating seat 41. An interior space of the hood 46 intercommunicates with an interior space of the electrically conductive tube 42. The heating coil 50 is disposed in the hood 46. An end of the hood 46 opposite to the electrically conductive tube 42 has an opening 461. The heating coil 50 is disposed between the opening 461 and the electrically conductive tube 42. The hood 46 includes a plurality of side holes 462 extending in radial directions of the electrically conductive tube 42. The plurality of side holes 462 intercommunicates the interior space of the hood 46 with an outside of the hood 46.

The air outlet tube 40 includes an air guiding tube 47 which is flexible. An end of the air guiding tube 47 is disposed on an end of the insulating seat 41 opposite to the electrically conductive tube 42. An interior space of the air guiding tube 47 intercommunicates with an interior space of the insulating seat 41. Another end of the insulating seat 41 is received in the electrically conductive tube 42. The interior space of the insulating seat 41 opposite to the air guiding tube 47 intercommunicates with the interior space of the electrically conductive tube 42.

An end of the central wire 44 opposite to the heating coil 50 extends between the electrically conductive tube 42 and the air guiding tube 47 and extends beyond the insulating seat 41. The body 20 receives a power supply 21 and a switch 22. The power supply 21 is connected to the switch 22, the air blowing pump 30, the end of the central wire 44 opposite to the heating coil 50, and the heating coil 50 by wires to form an electric circuit. The switch 22 controls running or stop of the air blowing pump 30 and controls heating or non-heating of the heating coil 50.

Figure 6:
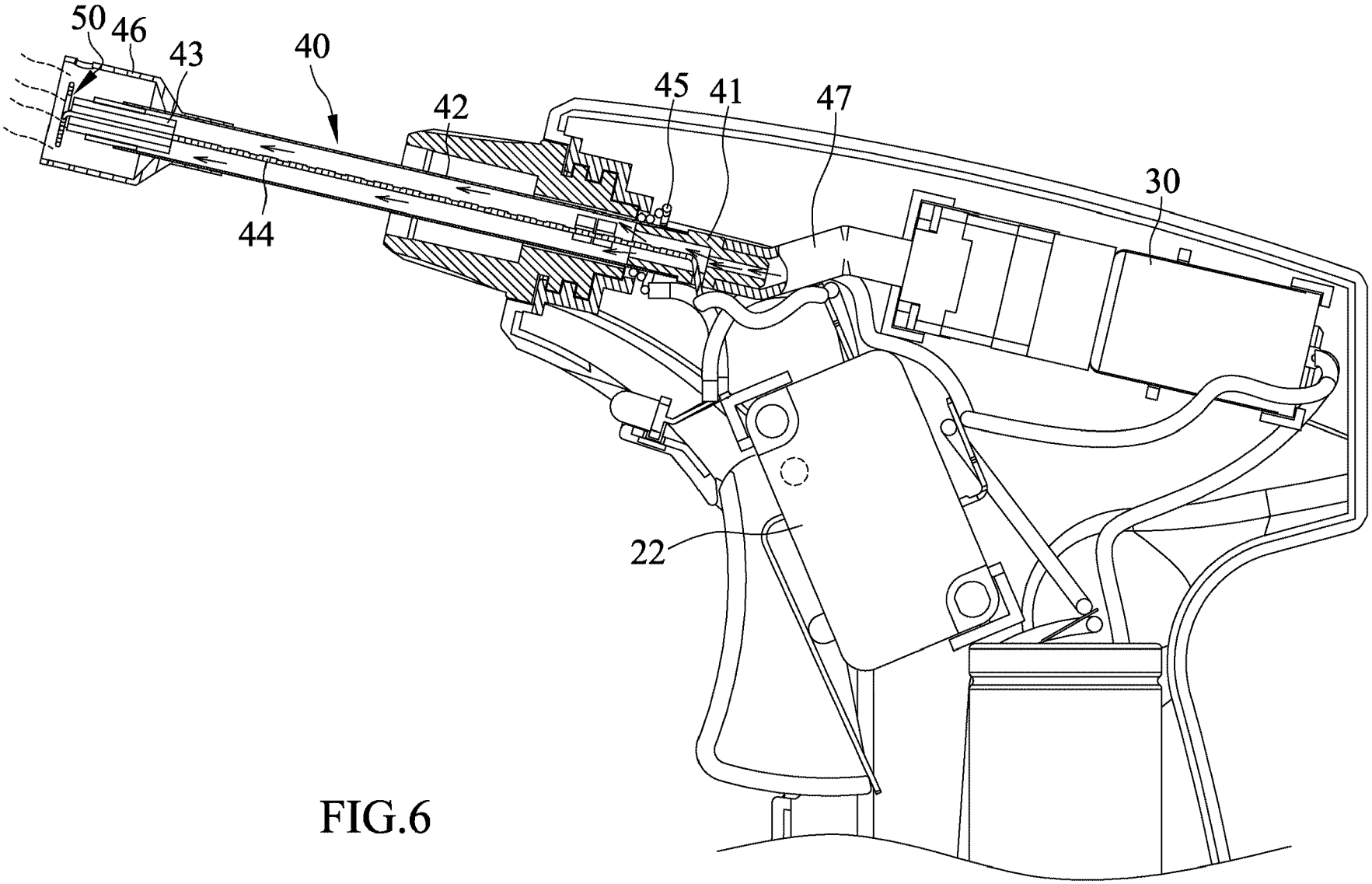
FIG. 6 is a cross sectional view illustrating use of the compact hot air gun according to the present invention.

FIG. 6 shows use of the compact hot air gun 10 according to the present invention. The compact hot air gun 10 can generate an ignition effect by using hot air through the above structure. The heating coil 50 is disposed on the front end of the air outlet tube 40 to provide high temperature at the front end of the air outlet tube 40, such that the compact hot air gun 10 can directly ignite an object without contacting with the object.

Conclusively, the compact hot air gun 10 is featured by comprising a body 20, an air blowing pump 30, an air outlet tube 40, and a heating coil 50. The air blowing pump 30 is disposed in the body 20. The air outlet tube 40 has an end connected to the air blowing pump 30 and another end extending beyond the body 20. The heating coil 50 is disposed in the another end of the air outlet tube 40 opposite to the air blowing pump 30. The compact hot air gun 10 can generate an ignition effect by using hot air through the above structure.

Although specific embodiments have been illustrated and described, numerous modifications and variations are still possible without departing from the scope of the invention. The scope of the invention is limited by the accompanying claims.

The invention claimed is:

1. A compact hot air gun comprising:

a body;

an air blowing pump disposed in the body; and an air outlet tube having an end connected to the air blowing pump and another end extending beyond the body, wherein the air outlet tube includes an insulating seat, an electrically conductive tube, an insulating tube, and a central wire, wherein the insulating seat is disposed in the body, wherein an end of the electrically conductive tube is connected to the insulating seat, wherein another end of the electrically conductive tube extends beyond the body, wherein the insulating tube is disposed in the electrically conductive tube, wherein the insulating tube is disposed opposite to the insulating seat, wherein the central wire is connected to the insulating seat, wherein an end of the central wire extends through an interior of the electrically conductive tube, wherein the central wire is not in contact with the electrically conductive tube; and a heating coil disposed in the another end of the air outlet tube opposite to the air blowing pump, wherein an end of the heating coil has a first connecting portion, wherein another end of the heating coil has a second connecting portion, wherein the first connecting portion is connected to the electrically conductive tube, and wherein the second connecting portion extends into the insulating tube and is connected to the central wire.

2. The compact hot air gun as claimed in claim 1, wherein the heating coil includes a heating portion between the end and the another end thereof, wherein the heating portion is coiled to form at least one circle, and wherein the heating portion is aligned with an outlet of the another end of the electrically conductive tube opposite to the insulating seat.

3. The compact hot air gun as claimed in claim 2, wherein an electrically conductive coil is connected to and mounted around the electrically conductive tube, and wherein the electrically conductive coil coils around the electrically conductive tube at least one turn.

4. The compact hot air gun as claimed in claim 3, the air outlet tube includes a hood is disposed on the another end of the electrically conductive tube opposite to the insulating seat, wherein an interior space of the hood intercommunicates with an interior space of the electrically conductive tube, wherein the heating coil is disposed in the hood, wherein an end of the hood opposite to the electrically conductive tube has an opening, wherein the heating coil is disposed between the opening and the electrically conductive tube, wherein the hood includes a plurality of side holes extending in radial directions of the electrically conductive tube, and wherein the plurality of side holes intercommunicates the interior space of the hood with an outside of the hood.

5. The compact hot air gun as claimed in claim 4, wherein the air outlet tube includes an air guiding tube which is flexible, wherein an end of the air guiding tube is disposed on an end of the insulating seat opposite to the electrically conductive tube, wherein an interior space of the air guiding tube intercommunicates with an interior space of the insulating seat, wherein another end of the insulating seat opposite to the air guiding tube is received in the electrically conductive tube, and wherein the interior space of the insulating seat intercommunicates with the interior space of the electrically conductive tube.

6. The compact hot air gun as claimed in claim 5, wherein an end of the central wire opposite to the heating coil extends between the electrically conductive tube and the air guiding tube and extends beyond the insulating seat, wherein the body receives a power supply and a switch, wherein the power supply is connected to the switch, the air blowing pump, the end of the central wire opposite to the heating coil, and the heating coil by wires to form an electric circuit, and wherein the switch controls running or stop of the air blowing pump and controls heating or non-heating of the heating coil.

* * * * *